United States Patent [19]

Yannazzone

[11] Patent Number: 5,074,349

[45] Date of Patent: Dec. 24, 1991

[54] WINDOW BLIND SLAT LADDER AND TILT DRUM

[75] Inventor: Robert Yannazzone, Union, N.J.

[73] Assignee: Levolor Corporation, Sunnyvale, Calif.

[21] Appl. No.: 571,054

[22] Filed: Aug. 21, 1990

[51] Int. Cl.[5] ..... E06B 9/38

[52] U.S. Cl. ..... 160/177; 160/176.1

[58] Field of Search ..... 160/176.1, 177, 178.1; 242/125.1

[56] References Cited

U.S. PATENT DOCUMENTS

| | | | |
|---|---|---|---|
| 774,188 | 11/1904 | Lamb | 242/125.1 |
| 812,412 | 2/1906 | Downs et al. | 242/125.1 |
| 1,969,924 | 8/1934 | Carter et al. | 242/125.1 X |
| 2,821,247 | 1/1958 | Satosky | 160/176.1 |
| 2,831,536 | 4/1958 | Lorentzen | 160/177 |
| 2,931,482 | 4/1960 | Bishop | 242/125.1 |
| 4,945,971 | 8/1990 | Ivarsson et al. . | |

*Primary Examiner*—Blair M. Johnson
*Attorney, Agent, or Firm*—Skjervan, Morrill, MacPherson, Franklin & Friel

[57] ABSTRACT

A venetian blind tilt drum eliminates the separate staples, crimped sleeves and bullet-like members normally used to connect the vertical legs of a cord tilt ladder to the drum. The tilt drum is of one-piece construction and includes a top surface from which preferably three cord impalement integral barbs extend. A first barb of generally pyramidal shape is positioned on an upper top surface of the drum on the drum vertical centerline, parallel to the longitudinal axis of the drum and with a pointed vertex of the barb extending above that axis. A pair of similar second and third barbs also integral with the drum are offset from the drum vertical centerline, with each pointed vertex also parallel to the drum longitudinal axis but extending in an opposite direction than the first barb. Depending on the particular tilt ladder construction the upper distal ends of the tilt ladder both may be impaled on the first barb or one distal end impaled on the second barb and the other distal end impaled on the third barb. Each barb may includes at least one notch adjacent to its base so as to retain portions of a pierced distal end or ends securely on the tilt drum. After the vertical legs of the tilt ladder have been affixed to the drum barbs, the drum is rotatable by rotary action of a blind slat tilt wand, tilt gearing and a tilt rod shaft.

20 Claims, 2 Drawing Sheets

WINDOW BLIND SLAT LADDER AND TILT DRUM

RELATED APPLICATION

This application relates to U.S. application Ser. No. 07/171,776, filed Mar. 22, 1988, now abandoned in the name of George Georgopoulos, et al entitled "Venetian Blind". The disclosure of the related application is incorporated herein by reference.

FIELD OF THE INVENTION

This invention is directed to a structure for fastening a tilt ladder of a venetian blind to a drum operable by rotational head movement of a tilt wand extending from a headrail or head channel of the blind. More particularly, the invention is directed an improved connection of the upper distal ends of a tilt ladder directly to a tilt drum.

BACKGROUND OF THE INVENTION

Many different mechanisms have been employed over the years for securing the vertical legs of a tilt ladder to a tilt drum. In venetian blinds two or more cord ladders extend from a headrail to a bottom rail of a venetian blind. Such ladders include cross-pieces or rungs which support the blind slats horizontally and, when the blind slats are to be tilted, move each slat simultaneously to tilt the array of slats to a desired angularity. The vertical ladder legs, normally in the form of cords, are connected to a rotary drum typically nested in a cradle, both mounted in the blind headrail. The drum is actuated by movement of a tilt wand extending from the headrail and normally hand-rotatable by a user. Rotary motion is transmitted to the drum by means of a tilt rod connected to a gearing assembly, which is in turn connected to thetilt wand. As the drum revolves on its longitudinal axis, the two vertical legs of the ladder raise and lower, providing the means for tilting the slats.

Early designs used a nominally 2.5–5.0 cm wide flexible ladder tape for the vertical legs with about 1 cm horizontal cross-pieces supporting each slat, the cross-pieces being sealed and held between two vertical tape layers. The tops of the two vertical tapes were attached to pairs of foldable tangs on a sheet metal drum of about the same width as the tape and a tape end stapled to the folded tangs to form a closed end loop. Rotation of the drum over about 120° in each direction from the slats horizontal position open and close the blind slats.

In subsequent prior art devices a smaller drum was employed having a single bendable tang forming an essentially closed loop. The top ends of vertical ladder cords are threaded through the closed loop and the distal ends of the cords clamped by suitable staples to inboard portions of the vertical ladder cords forming a cord loop within the drum tang loop. Other manufacturers have used a construction including a brass sleeve crimped around the distal ends of each vertical ladder portion, the sleeves being then directly passed into opposed small holes on the side of the drum and the relatively longer sleeves oriented to be essentially parallel to the longitudinal axis of the drum, or by crossing the ladder legs and running them to holes on opposite sides of the drum so as to hold the ladder depending therefrom.

Plastic rotatable drums have been employed having longitudinal sleeves into which a metal sleeve crimped on the vertical ladder end is inserted. A top entry slit has been included in the plastic sleeves to aid in locking the ladder and metal sleeve into each drum sleeve. An improvement to this general type of construction is seen in the related application where sleeved ends of a ladder cord are inserted into integral sleeves extending from a tilt drum. Another type of ladder-to-drum connection is described in a U.S. patent application now U.S. Pat. No. 4,495,971 of S. Smederod and K. Caysson of S. Ivarson, Sweden, which employs small bullet-like plastic members which have a sharp point which pierces through a vertical ladder portion. The member and ladder end is then jammed into a drum sleeve for holding the ladder end therein. As can be seen each of the above constructions employ separate staples, sleeves or bullets which are affixed to the ladder top distal ends and then that assembly is attached to the drum in various fashions. The use of staples, sleeves and bullets add additional elements to the assembly and increase the cost of manufacture and assembly.

SUMMARY OF THE INVENTION

The present invention eliminates the need for any staple, sleeve or bullet previously used in the prior art to connect the ladder vertical legs to the tilt drum. This is accomplished by incorporating one or more integral pointed barbs on the drum itself so that the distal ends of the vertical legs of the tilt ladder cords may be forced against a barb with the barb point piercing the cord and the pierced split cord firmly held on an outside, preferably upper, surface of the drum. In the preferred embodiment the drum includes three barbs, a first barb placed longitudinally of the drum on the drum vertical centerline and the other two second and third barbs placed off center also longitudinally of the drum but pointed in an opposite direction than the first barb.

Each barb preferably has an essential pyramidal shape, with essentially flat triangular faces meeting at a pointed vertex. At the base of each barb, an essentially rectangular or square indentation is provided to receive and retain the leg(s) of the split ladder tape(s) in a fixed position with respect to the drum.

The choice of three barbs over one integral barb or two integral barbs anticipates the use of different ladders and different head loops. The distal ends of two vertical legs of the ladder tape can be placed together over one centered barb, or placed individually over the two oppositely positioned barbs.

The remainder of the drum construction is essentially of the construction shown in the related application, particularly in FIGS. 2, 13, 14 and 16, where a blind tilt wand rotates suitable gearing and a tilt rod which rotates the drum in a suitable cradle or the like. The tilt cord vertical ladder legs are thus variously pulled upwardly by the rotating drum as the drum rotates in one or another direction starting to wind a vertical leg distal end partially around the drum exterior below the barbed upper surface. This rotation action, as known in art, tilts the blind slats which are supported by the cross-members (rungs) of the ladder cords.

The present invention has certain advantages over the previous constructions with regard to assembly and manufacture. The traditional method of assembling a blind requires a pre-assembly of ladder tapes, where the ladder is cut to size and brass sleeves are crimped to each of the four legs of the ladder. A production run of ladders is linked together with paper connectors, and fed continuously through a venetian blind assembly machine. The blind's headchannel is pre-assembled with a tilt wand, gearing, tilt rod, cradles and drums prior to the assembly station. At final assembly, the sleeves on the ladder ends are inserted through eyelets in the bottom surface to the headchannel, fed alternately across the top of the drum and inserted into drum holes.

The present invention eliminates the crimped sleeves on the upper ladder legs. At assembly, the length of the ladder is established, the vertical legs are cut to size, and one or two upper cross members (rungs) are cut free. The ladder legs are then passed through eyelets in the bottom surface of the head channel, and fed to the drum's integral barbs. The ladder legs are then pulled over, the barbs with the barbs piercing and splitting the cord legs at that point, this impaling the distal ends of the legs on the barb(s).

The manufactured cost of goods is reduced with the lower cost and number of parts, and with the reduction in assembly time. Further, the exact location of the loops at each junction of the vertical ladder legs and cross members dictates the exact location at which the ladder is attached to the barb(s). This overcomes the historic difficulty of accurately locating and crimping the metal sleeves to the ladder legs. Additionally, the fairly often tendency of the metal sleeves to fall out of the drums during shipping and handling has been completely eliminated.

BRIEF DESCRIPTION OF THE DRAWINGS

FIG. 1 is an exploded perspective view of the barbed drum of the invention with a tilt wand connector shaft.

DETAILED DESCRIPTION

Figure 1A:
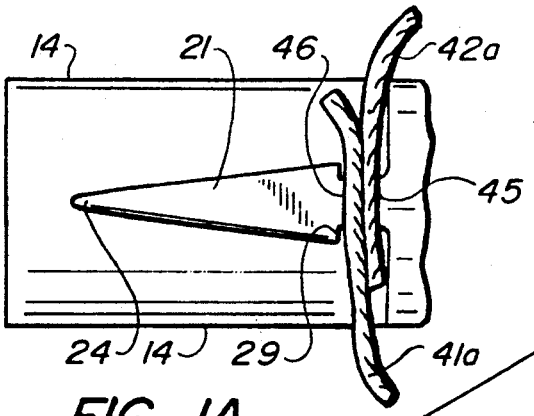
FIG. 1A is a partial top view of the drum showing impalement of both vertical ladder legs on a single barb.

FIG. 1 illustrates the tilt drum 10 of the invention which includes a drum housing 11 having an upper surface 12 and opposed sides 14. The drum housing is mounted in a cradle (not shown) which in turn is fixedly mounted in a headrail 30 (FIG. 2) as drums are typically mounted and as seen in the related application. The tilt drum housing has an approximate half-round bore 16 into which a tilt rod connector shaft 17 having a flatten half-round end 18 is inserted. As also seen in the related application gearing, a tilt wand joint and a tilt wand are connected to tilt rod shaft 17 for rotating the tilt drum 10. This tilt action is illustrated by comparing FIGS. 2 and 3. The tilt drum housing upper surface 12 includes an integral vertical wall 20 from which extend three integral impalement barbs 21, 22 and 23. The tilt drum 10 is of one-piece construction, preferably of a molded plastic piece of acetal resin PMS-406 or similar material. The tilt drum also may be a zinc die casting.

Figure 2:
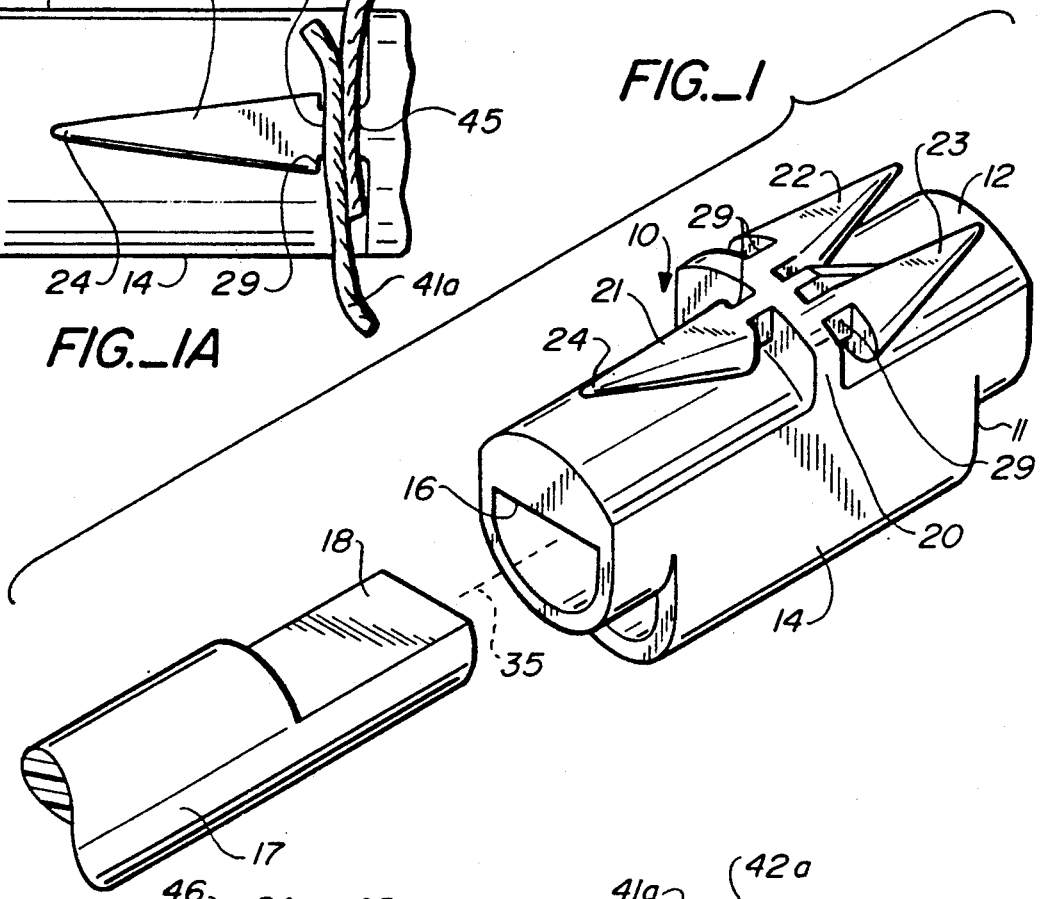
FIG. 2 is an end view of the barbed drum showing the distal ends of both vertical legs of a tilt ladder passed through headrail eyelet and impaled on a single drum barb.
Figure 2:
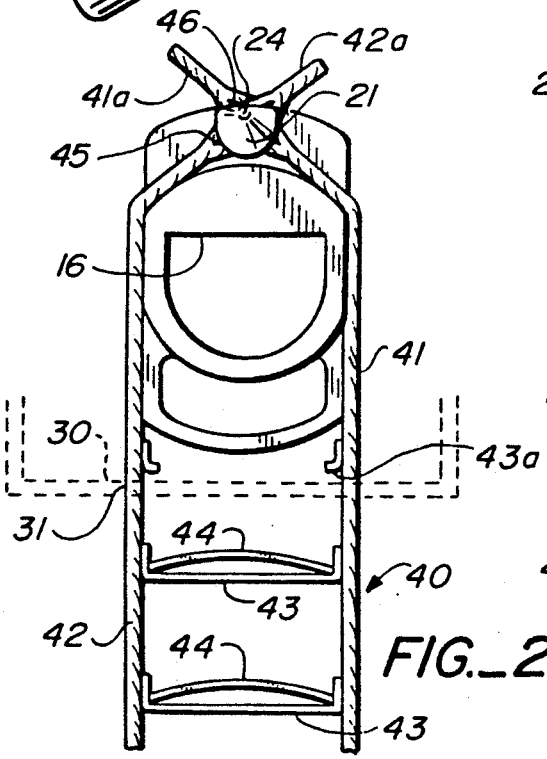
Figure 3:
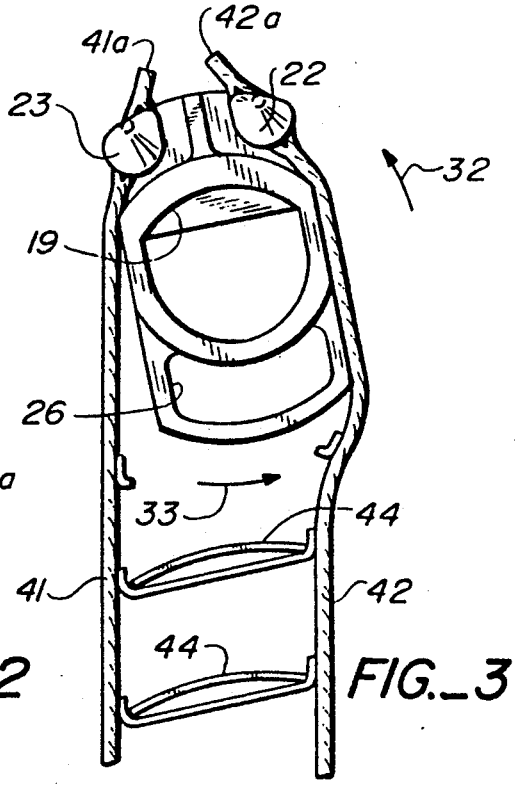
FIG. 3 is an opposite end view of a partially tilted barbed drum showing the distal end of each vertical leg of a tilt ladder impaled individually on each of two parallel barbs both extending in an opposite direction than the single barb of FIG. 2.

Barb 21 is positioned on the vertical centerline of the drum housing, extends parallel to the longitudinal axis 35 of the housing 11 and above curved upper surface 12 so that a sharp cord-piercing tip or vertex 24 extends in a direction parallel to bore 16. A rectangular notch 29 is provided in the base of each barb, on an outside portion on barbs 22 and 23 and on both exterior sides of barb 21, the purpose of which is seen in FIGS. 1A, 2 and 3. Each of the barbs 21, 22 and 23 have an essentially pyramidal shape with flat triangular faces meeting at a pointed vertex 24 onto which the distal ends of the ladder cord legs are initially impaled. A distal end **42*a* of a vertical cord leg 42 followed by distal end 41*a* of cord leg 41 are positioned so that movement of the distal ends against pointed vertex 24 permits the barb to essentially bisect or split the cord legs distal ends. The resultant cord portions then are passed down opposite barb sides together until one portion or both are retained in the notch or notches 29, respectively, in the base of the particular barb. Small triangular-shaped openings 45, 46 in the cord immediately adjacent to the barb are normally observed. The impaled distal ends 41*a* and 42*a* extend tangentially along the drum upper surface to the top side edges of the drum and then extend downwardly along the sides 14 of housing 11 to the remainder of the tilt ladder as seen in FIG. 2**.

FIG. 2 illustrates the impalement of both distal ends **41*a* and 42*a* on a first barb 21 by forcedly passing the distal ends over the pointed vertex 24. The distal ends of vertical legs 41 and 42 then extend through grommeted apertures 31 in the bottom of headrail 30, the distal ends having been passed through the grommets initially before impalement on the barb. Woven cord cross-rungs 43 extend between vertical legs 41 and 42 to both support the blind slats 44 and to provide for the tilting action. One or more of the top rungs 43*a* are cut in two or the major part removed allowing the distal ends of the legs to pass around and over the drum. The tilt action is seen in FIG. 3 where the tilt drum is rotated as seen by arrow 33 by rotary movement of tilt rod shaft 17 through gearing connected to a tilt wand (not shown). As the drum rotates, ladder leg 41 rises as shown by arrow 32 tilting slats 44 and causing the distal end 41*a* to wrap around a portion of the drum. Rotation of the tilt wand, tilt rod and tilt drum in an opposite direction tilts the slats in an opposite orientation. FIG. 3 illustrates an operational embodiment in which each distal end is mounted on a separate parallel barb, i.e. distal end 41*a* on barb 23 and distal end 42*a* on barb 22**.

Figure 5:
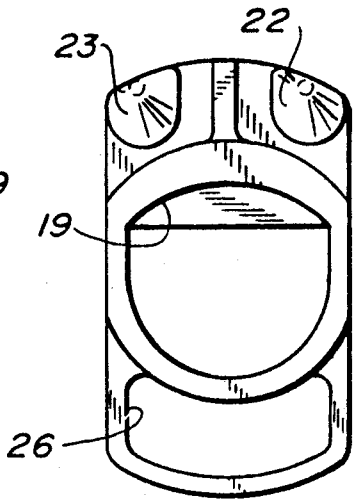
FIG. 5 is a detailed end view taken on the line 5—5 of FIG. 7 showing the double integral barbs on the drum.
Figure 4:
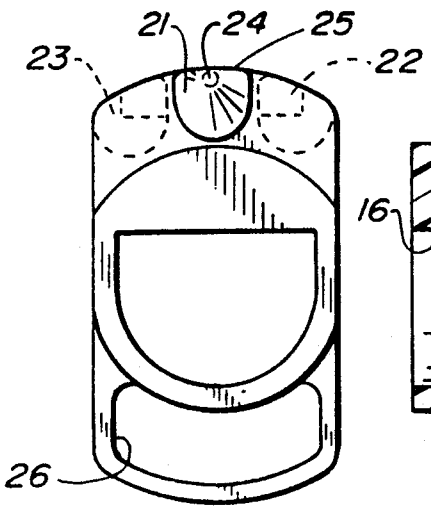
FIG. 4 is a detailed end view taken on the line 4—4 of FIG. 7 showing the single integral barb on the drum.

FIGS. 4 and 5 show the end orientations of the single barb 21 end and the double barb 22 and 23 end of the tilt drum respectively. Openings 19 and 26 function to reduce the material cost of the molded part. Further, the generally oval shape of drum with parallel sides 14 also minimizes the material used and the space required in the headrail for the drum and its cradle.

Figure 6:
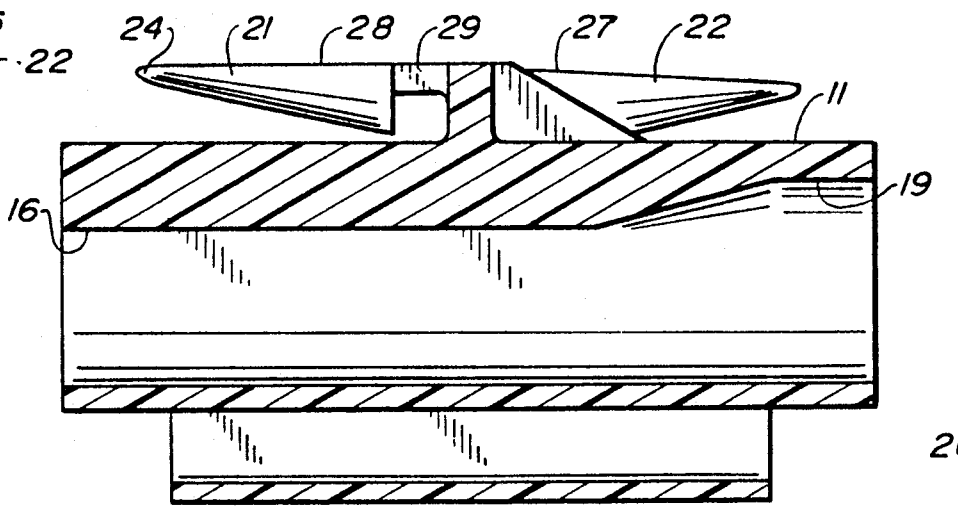
FIG. 6 is a partial cross-sectional side view of the barbed drum taken on the line 6—6 of FIG. 7.
Figure 7:
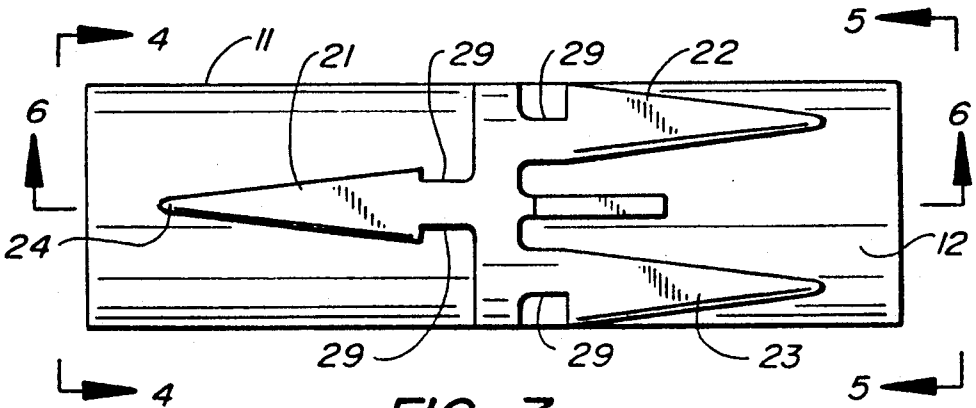
FIG. 7 is a top view of the barbed drum.

FIG. 6 shows the interior of housing 11 including tilt rod entry bore 16 and leading edge 19 for assembly Details of the shape of the barbs including the offset of the vertex 24 to a position juxtaposed to surfaces 27, 28 is also seen. FIG. 7 illustrates a top view of the tilt drum particularly showing the cord retention notches 29.

The above description of the preferred embodiment of this invention is intended to be illustrative and not limiting. Other embodiments of this invention in which only one or two integral barbs are employed on the upper surface or a pair of integral barbs are provided on side surfaces of the drum housing will be obvious to those skilled in the art in view of the above disclosure.

I claim:

1. In combination, a blind tilt ladder having a pair of spaced vertical cord legs, transverse blind slat-supporting cross-rungs extending between said legs and a pair of upper distal cord ends of such vertical legs; and a tilt drum adapted to be mounted in a blind headrail, said tilt drum having an outer surface including at least one impalement barb extending from said outer surface and wherein said distal cord ends of such ladder vertical legs are impaled on said at least one impalement barb by piercing of said at least one barb through said cord ends to split a portion of said cord ends and to retain said tilt ladder on said drum.

2. The combination of claim 1 wherein said at least one impalement barb is integral with said tilt drum.

3. The combination of claim 1 wherein said tilt drum and said at least one impalement barb are of a one-piece construction.

4. In combination, a blind tilt ladder having a pair of spaced vertical legs, transverse blind slat-supporting cross-rungs extending between said legs and a pair of upper distal ends of such vertical legs; and a tilt drum adapted to be mounted in a blind headrail, said tilt drum having an outer surface including at least one impalement barb extending from said outer surface and wherein said distal ends of such ladder vertical legs are impaled on said at least one impalement barb to retain said tilt ladder on said drum; and in which said at least one impalement barb comprises a first cantilevered barb extending along a vertical centerline from an upper surface of said tilt drum, parallel to a longitudinal axis of said tilt drum; and a pair of spaced second and third cantilevered barbs offset from said vertical centerline on said upper surface and extending parallel to said longitudinal axis in a direction opposite to said first cantilevered barb.

5. The combination of claim 4 wherein each of said barbs includes a base end notch and wherein pierced sections of said vertical legs distal ends extend into said base end notch to retain said distal ends on at least one of said barbs.

6. The combination of claim 5 wherein a vertical leg distal end is impaled on said second cantilevered barb and the other vertical leg distal end is impaled on said third cantilevered end.

7. The combination of claim 5 wherein said pair of upper distal ends are both impaled on said first cantilevered barb.

8. The combination of claim 1 wherein said impaled distal ends extend from said at least one barb tangentially of a curved upper surface of said tilt drum to opposed parallel sides of said tilt drum, thence downwardly essentially parallel to said tilt drum sides to the tilt ladder cross-rungs.

9. In combination, a blind tilt ladder having a pair of spaced vertical legs, transverse blind slat-supporting cross-rungs extending between said legs and a pair of upper distal ends of such vertical legs; and a tilt drum adapted to be mounted in a blind headrail, said tilt drum having an outer surface including at least one impalement barb extending from said outer surface and wherein said distal ends of such ladder vertical legs are impaled on said at least one impalement barb to retain said tilt ladder on said drum; and wherein said at least one impalement barb has an essentially pyramidal shape with flat triangular faces meeting at a pointed vertex.

10. The combination of claim 9 wherein a base of said at least one impalement barb includes an essentially rectangular notch for receiving pierced portions of said distal ends to retain said vertical legs in a fixed position with respect to said drum.

11. In combination, a window blind salt tilt ladder and a tilt ladder drum, said drum comprising:

an elongated drum housing;

means in said housing for receiving a rotatable tilt rod shaft, a drum housing outer surface;

at least one impalement barb having a sharp cord-piercing tip extending from said drum outer surface; and wherein said tilt ladder includes a pair of vertical cord legs having a distal cord end on each of said vertical cord legs, said distal cord ends being pierced by and partially split by the tip of said at least one impalement barb to retain said cord ends on said at least one barb.

12. The drum of claim 11 wherein said at least one impalement barb and said drum housing are of a one-piece integral construction.

13. A tilt ladder drum comprising:

an elongated drum housing;

means in said housing for receiving a rotatable tilt rod shaft, a drum housing outer surface;

at least one impalement barb extending from said drum outer surface; and wherein a distal end of each of two vertical legs of a blind slat tilt ladder are impaleable on said at least one impalement barb; and in which said at least one impalement barb comprises a first cantilevered barb extending along a vertical centerline from an upper surface of said tilt drum, parallel to a longitudinal axis of said tilt drum; and a pair of spaced second and third cantilevered barbs offset from said vertical centerline on said upper surface and extending parallel to said longitudinal axis in a direction opposite to said first cantilevered barb.

14. The drum of claim 13 wherein each of said barbs includes a base end notch and wherein impaled split portions of the legs distal ends seat in said notch to retain the distal ends in said notch.

15. The drum of claim 13 wherein a vertical leg distal end is impaled on said second cantilevered barb and the other vertical leg distal end is impaled on said third cantilevered barb.

16. The drum of claim 13 wherein the pair of distal ends are both impaled on said first cantilevered barb.

17. The drum of claim 13 wherein said first, second and third barbs integrally extend from an upper surface of said drum housing and wherein each of said barbs has an essentially pyramidal shape with triangular faces meeting at a pointed vertex.

18. The drum of claim 17 wherein a base of each of said barbs includes an essentially rectangular notch for receiving pierced portions of the distal ends.

19. The combination of claim 1 wherein said tilt drum and said at least one impalement barb is of a one-piece construction and extends longitudinally parallel to a central vertical longitudinal plane of said tilt drum and is displaced radially from a juxtaposed outer surface of said tilt drum.

20. The combination of claim 1 in which said at least one impalement barb comprises a pair of spaced cantilevered barbs extending from a surface of said tilt drum and displaced radially outward from juxtaposed outer surfaces of said tilt drum.

* * * * *

UNITED STATES PATENT AND TRADEMARK OFFICE

CERTIFICATE OF CORRECTION

PATENT NO. : 5,074,349
DATED : December 24, 1991
INVENTOR(S) : Robert Yannazzone

It is certified that error appears in the above-identified patent and that said Letters Patent is hereby corrected as shown below:

Claim 11, Col. 6, line 6, delete "salt" and insert --slat--.

Signed and Sealed this

Eleventh Day of May, 1993

*Attest:*

Michael K. Kirk

MICHAEL K. KIRK

*Attesting Officer*

*Acting Commissioner of Patents and Trademarks*